US006899179B2

(12) United States Patent
McGarian et al.

(10) Patent No.: US 6,899,179 B2
(45) Date of Patent: May 31, 2005

(54) BYPASS VALVE

(75) Inventors: Bruce McGarian, Aberdeen (GB); Ian A. Gillies, Angus (GB)

(73) Assignee: Smith International, Inc., Houston, TX (US)

( * ) Notice: Subject to any disclaimer, the term of this patent is extended or adjusted under 35 U.S.C. 154(b) by 92 days.

(21) Appl. No.: 10/276,546

(22) PCT Filed: Apr. 24, 2001

(86) PCT No.: PCT/GB01/01826

§ 371 (c)(1),
(2), (4) Date: Nov. 18, 2002

(87) PCT Pub. No.: WO01/88327

PCT Pub. Date: Nov. 22, 2001

(65) Prior Publication Data

US 2004/0007361 A1 Jan. 15, 2004

(30) Foreign Application Priority Data

May 19, 2000 (GB) ..... 0012202

(51) Int. Cl.[7] ..... E21B 34/10
(52) U.S. Cl. ..... 166/332.2; 166/321
(58) Field of Search ..... 166/319, 320, 166/321, 324, 332.1, 332.2, 332.7, 316, 183

(56) References Cited

U.S. PATENT DOCUMENTS

| | | | | |
|---|---|---|---|---|
| 4,298,077 A | | 11/1981 | Emery | 175/65 |
| 4,936,397 A | | 6/1990 | McDonald et al. | 175/26 |
| 5,465,787 A | | 11/1995 | Roth | 166/66.4 |
| 5,979,572 A | | 11/1999 | Boyd et al. | 175/105 |
| 6,095,249 A | * | 8/2000 | McGarian et al. | 166/319 |
| 6,173,795 B1 | * | 1/2001 | McGarian et al. | 166/321 |

FOREIGN PATENT DOCUMENTS

| | | | |
|---|---|---|---|
| EP | 0 860 583 | 8/1998 | |
| GB | 2 302 895 | 2/1997 | |
| GB | 2 307 932 | 6/1997 | |
| GB | 2 309 470 | 7/1997 | |
| GB | 2 352 511 | 1/2001 | |
| WO | WO 97/21020 | 6/1997 | |
| WO | WO 97/47850 | * 12/1997 | E21B/21/10 |
| WO | WO 99/47789 | 9/1999 | |
| WO | WO 00/55472 | 9/2000 | |

* cited by examiner

*Primary Examiner*—David Bagnell
*Assistant Examiner*—Matthew J. Smith
(74) *Attorney, Agent, or Firm*—Dykema Gossett PLLC

(57) ABSTRACT

Bypass valve for use in wellbores, particularly during the setting of hydraulic anchor packers, a bypass valve is provided with a body (4) incorporating a wall provided with at least one opening (20) and a piston (30) slidably mounted and having a longitudinal bore extending therethrough. The piston (30) is movable between a first position, in which the bore of the piston (30) is substantially isolated from the exterior of the body (4), and a second position in which a passage is provided from the bore of the piston (30) to the exterior of the body (4). Constraining means (42, 52) prevent movement of the piston (30) from the first to the second position. Overriding means are provided to permit movement to the second position.

11 Claims, 2 Drawing Sheets

BYPASS VALVE

Figure 1:
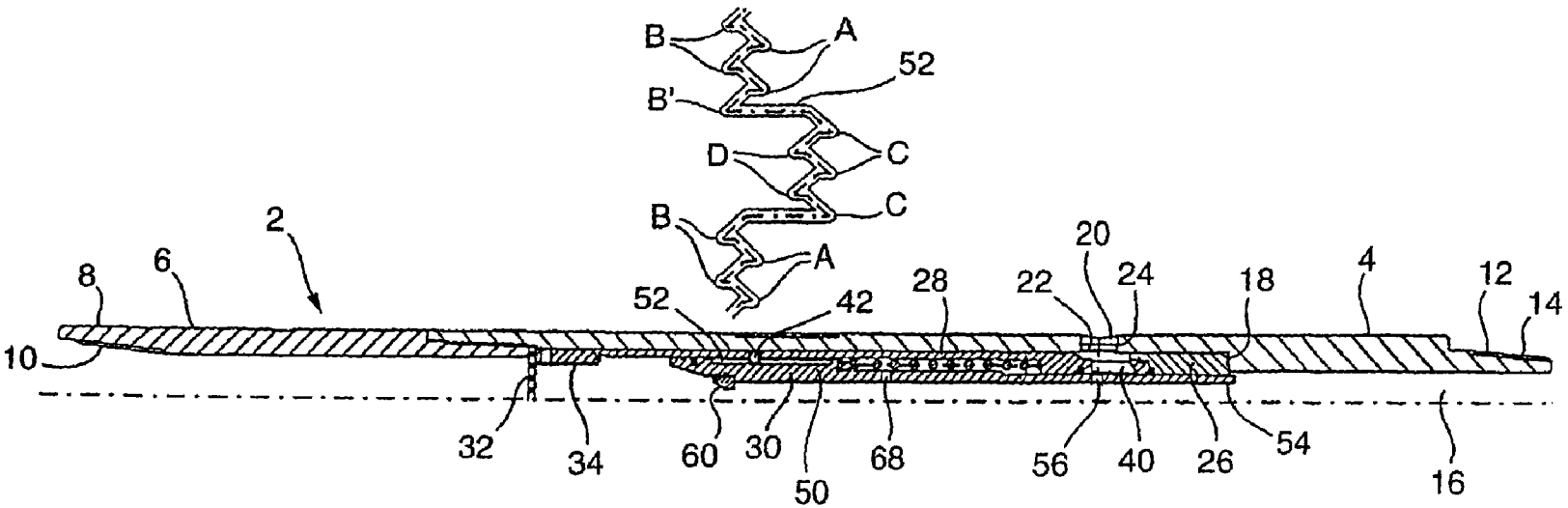

The invention relates to bypass valves for use in wellbores, particularly but not exclusively to bypass valves used during the setting of hydraulic anchor packers.

The drilling industry often has the need to monitor the axial position and angular orientation of a tool (such as a whipstock) within a wellbore, and to rigidly secure the tool within the wellbore once a required position and orientation has been achieved. The position and orientation of a tool may be determined by using a MWD or Measurement-While-Drilling tool. An MWD tool requires a flow of wellbore fluid through a drill string in order to communicate a measured position and orientation to the surface. The flow rates required are often sufficiently high to generate a pressure drop between the inside and the outside of the drill string to prematurely set the hydraulic anchor packer.

To overcome this problem, drill strings are often provided with a bypass valve located between the MWD tool and the anchor packers. When the position and orientation of the drill string is being monitored, wellbore fluid is pumped through the MWD tool via the bore in the drill string. The bypass valve prevents the setting of the anchor packers by allowing the wellbore fluid flowing downhole of the MWD tool to pass into the wellbore annulus. The fluid pressure differential across the hydraulic anchor packer is thereby maintained below the setting pressure.

Once the required drill string position and orientation is obtained, the hydraulic anchor packer is set by increasing the flow rate of the wellbore fluid down the drill string. The increase in flow rate results in an associated increase in dynamic pressure. Once the dynamic pressure increases to a predetermined magnitude, the bypass valve is activated and the fluid path between the wellbore annulus and the drill string bore is closed. The wellbore fluid is thereby directed downhole to the anchor packers where the appropriate setting pressure (typically a 1500–3000 psi differential between the inside and outside of the anchor packer) is then applied.

A conventional bypass valve incorporates a piston which slides within a cylinder in response to dynamic wellbore fluid pressure. The wall of the cylinder is provided with a plurality of vent holes through which fluid may pass from the drill string bore to the wellbore annulus. The piston is generally held in an open position by biasing means, such as a spring. When the appropriate dynamic pressure is achieved, the biasing means is overcome and the piston slides within the cylinder so as to sealingly close the plurality of holes.

This type of bypass valve can be problematic in circumstances where it is desirable for the vent holes to remain sealingly closed when fluid flow through the valve is stopped and dynamic pressure is accordingly removed.

It is an object of the present invention to provide a bypass valve for use in a wellbore which may remain in a closed configuration regardless of dynamic pressure variations therein.

The present invention provides a bypass valve for selectively isolating the interior of a downhole assembly from the exterior thereof, the bypass valve comprising: a body incorporating a wall provided with at least one opening extending therethrough; a piston slidably mounted in the body and having a longitudinal bore extending therethrough; the piston being moveable between a first position relative to the body, in which the bore of the piston is substantially isolated from the exterior of the body, and a second position relative to the body, in which a passage is established from the bore of the piston to the exterior of the body via said at least one opening; constraining means for controlling movement of the piston in response to fluid pressure applied to the piston, said constraining means preventing movement of the piston from the first position to the second position; and overriding means for overriding the constraining means so as to permit movement of the piston to the second position.

The piston may have a third position relative to the body in which a restricted passage is established from the bore of the piston to the exterior of the body via said at least one opening. Movement of the piston to the third position is preferably only permitted by operation of the overriding means.

The piston is preferably biased to the first position by means of a spring. Furthermore, the piston may incorporate a wall provided with at least one opening extending therethrough so that, in the first position, the openings of the piston and body are not in register with another, and in the second position, the openings of the piston and the body are in register with one another.

Preferably the constraining means comprises a guide pin and a guide slot for receiving the guide pin. The guide slot is preferably provided about the outer peripheral surface of the piston and extends in a direction having one component parallel to the direction of axial movement of the piston. The overriding means may be provided by an extension of the guide slot.

Preferably the guide pin is fixedly located relative to the body and the guide slot is formed in the exterior surface of the piston.

Connecting means may be provided for connecting a nozzle to the piston. Furthermore, a filter may be provided adjacent the or each opening of the body. It may also be desirable to provide a filter for filtering a fluid flowing into the bore of the piston.

The bypass valve provided by the present invention has the advantage over conventional bypass valves of remaining in a closed configuration further to variations in fluid flow. With a bypass valve according to the present invention arranged in a closed configuration, a milling operation may be stopped and restarted several times without the bypass valve moving to an open configuration.

Figure 2:
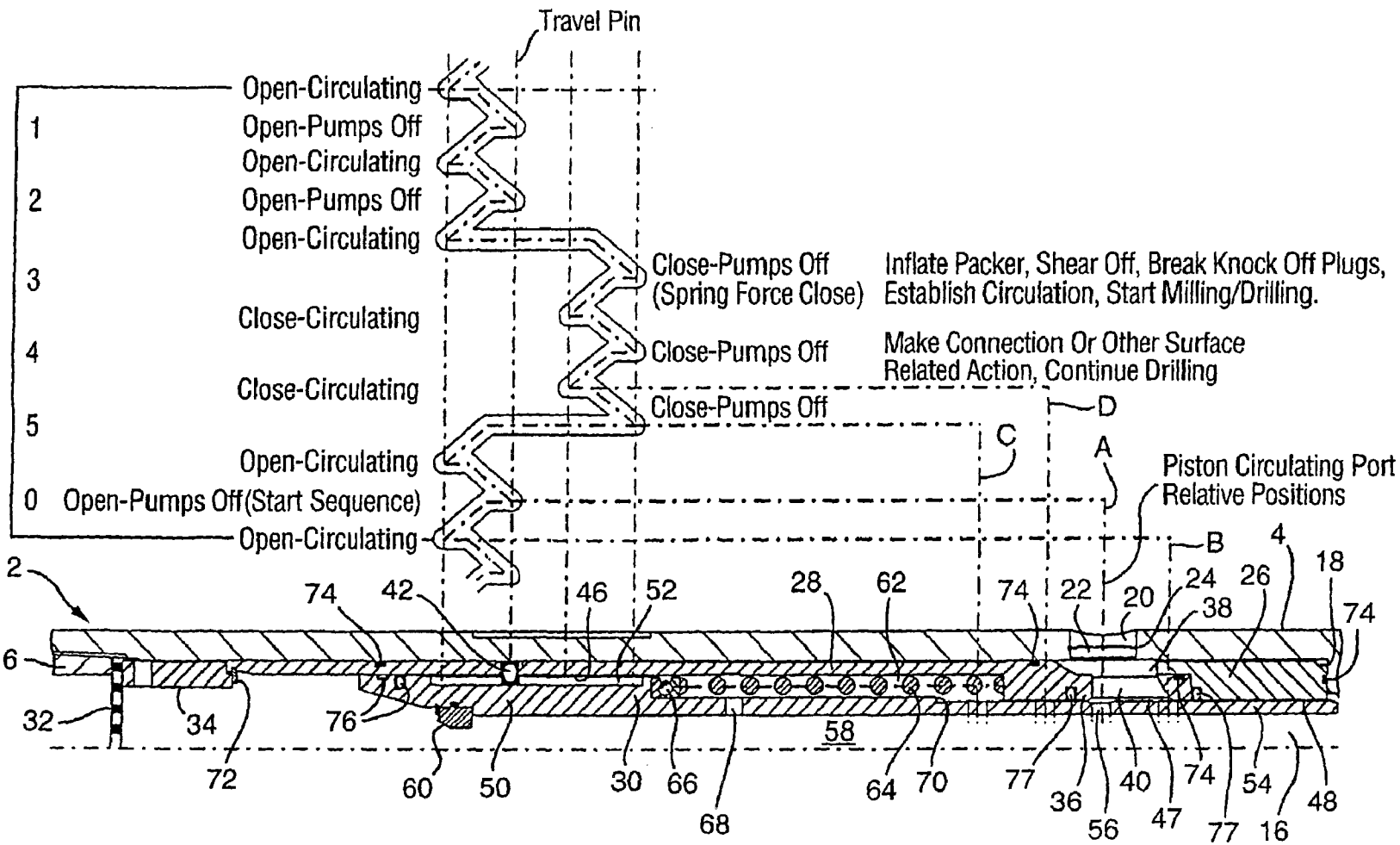

An embodiment of the present invention will now be described with reference to the accompanying drawings, in which:

FIG. 1 is a cross-sectional partial side view of an embodiment of the present invention; and FIG. 2 is an enlarged cross-sectional partial side view of the embodiment of FIG. 1.

The embodiment of FIGS. 1 and 2 is a bypass valve defined by a plurality of internal parts mounted within a shell 2.

The shell 2 comprises a casing 4 threadedly connected to a crossover member 6. The upper end 8 of the crossover member 6 is provided with an internal screw thread 10. Assemblies to be arranged uphole of the bypass valve are connected to the crossover member 6 by means of the internal screw thread 10. The lower end 12 of the casing 4 is provided with an external thread 14. Assemblies to be arranged downhole of the bypass valve are connected to the casing 4 by means of the external thread 14. The casing 4 and the crossover member 6 define a bore 16 in which the internal parts of the bypass valve are located. The portion of the bore 16 defined by the casing 4 is provided with a shoulder 18 which prevents undesirable axial movement of the internal parts towards the lower end 12. Four vent holes 20 are provided in the casing 4 in a coplanar arrangement, uphole of the shoulder 18 and equispaced about the circumference of the bore 16. The vent holes 20 allow fluid to either enter the bypass valve from the wellbore annulus or enter the wellbore annulus from the bypass valve. Each vent hole 20 is provided with a filter disc 22 held in position by means of a filter disc circlip 24.

The plurality of internal parts include a seal housing 26, a sleeve 28, a piston 30, an internal filter 32 and an adjusting ring 34. The seal housing 26 is substantially cylindrical in shape and has an outer diameter similar to the diameter of the bore 16 defined by the portion of the casing 4 uphole of the shoulder 18. The seal housing 26 is located downhole of the vent holes 20 and is arranged so as to abut the shoulder 18.

The sleeve 28 is also substantially cylindrical in shape, the upper end thereof having an outer diameter similar to that of the seal housing 26. The lower end 36 (see FIG. 2) of the sleeve 28 has an outer diameter which is less than that of the seal housing 26. The sleeve 28 is arranged within the casing 4 with the lower end 36 of the sleeve 28 located in abutment with the seal housing 26. A vent chamber 38 in fluid communication with the vent holes 20 is defined by the lower end 36 of the sleeve 28, the seal housing 26 and the casing 4. The vent chamber 38 defines an annulus shape and is located between the sleeve 28 and the casing 4. The vent chamber 38 is also in fluid communication with a plurality of vent chamber ports 40. The vent chamber ports 40 are provided in the form of slots located in a recess 47 defined in the lower end 36 of the sleeve 28.

The upper end of the sleeve 28 is provided with a guide pin hole. A guide pin 42 is push fitted within this hole and is provided with a blind screw threaded recess for receiving an extractor tool. The guide pin 42 extends from the inner surface 46 of the sleeve 28.

The piston 30 is located in abutment with the inner surface 46 of the sleeve 28 and the inner surface 48 of the seal housing 26. The arrangement is such that the piston 30 may rotate and move axially within the sleeve 28 and the seal housing 26. The upper end 50 of the piston 30 is provided with a guide slot 52 in which the guide pin 42 is located. The guide slot 52 has an unbroken profile defined around the circumference of the upper end 50 of the piston 30. The unwrapped profile of the guide slot 52 is shown in the accompanying drawings. The location of the guide pin 42 in the guide slot 52 limits the movement of the piston 30 relative to the sleeve 28. The lower end 54 of the piston 30 extends beyond the vent chamber ports 40 and is provided with a plurality of piston holes 56 in the form of elongated slots. The piston holes 56 allow wellbore fluid to pass from the vent chamber 38 to a piston bore 58 defined by the piston 30. The upper end 50 of the piston 30 is also provided with a nozzle 60 so as to effectively reduce the diameter of the piston bore 58. The attachment of a nozzle 60 to the piston 30 with appropriate connecting means reduces the flow rate of wellbore fluid required to move the piston 30 axially within the sleeve 28. The flow rate at which the bypass valve closes may therefore be varied with the provision of a suitable nozzle.

The piston 30 and the sleeve 28 define a piston spring chamber 62 in which a piston spring 64 is located. The piston spring 64 abuts the lower end 36 of the sleeve 28 and the upper end 50 of the piston 30, and is arranged so as to bias the piston 30 towards the upper end 8 of the crossover member 6. A ball bearing assembly 66 is provided between the piston spring 64 and the upper end 50 of the piston 30 so as to reduce to a minimum any transfer of torque from the piston 30 to the piston spring 64. Axial movement of the piston 30 is assisted by the venting of the piston spring chamber 62 to the piston bore 58 by means of a piston spring chamber port 68. The piston spring chamber port 68 takes the form of holes in the sleeve 28 providing fluid communication between the piston spring chamber 62 and the piston bore 58. The axial movement of the piston 30 is restricted by a piston stop 70 and a piston circlip 72, and also by the location of the guide pin 42 within the guide slot 52.

The internal filter 32 is located uphole of the piston 30 between the crossover member 6 and the adjusting ring 34. The internal filter 32 is capable of filtering debris having a dimension greater than ⅛ inch. The adjusting ring 34 extends downhole of the internal filter 32 so as to abut the sleeve 28. Seals 74 are provided in order to prevent undesirable ingress of wellbore fluid. Glyd ring seals 76, 77 are also provided to assist with the movement of piston 30 within the sleeve 28 and the seal housing 26.

The components of the bypass valve are manufactured from a suitable grade of steel. The interfacing portions of the lower end 36 and the piston 30 are coated with tungsten carbide so as to improve the wear resistant characteristics of the bypass valve. The glyd ring seals are manufactured from PTFE. Alternative materials will be apparent to a reader skilled in the art.

The bypass valve of FIGS. 1 and 2 is assembled by sliding the piston spring 64, the ball bearing assembly 66 and the piston 30 into the sleeve 28. The piston circlip 72 is then located in position so as to prevent the piston spring 64 from pushing the piston 30 from the sleeve 28. The guide pin 42 is located within the guide slot by aligning the guide pin hole with the guide slot 52 and then screwing the guide pin 42 into the guide pin hole. A piston assembly is thereby defined. The seal housing 26, the piston assembly, the adjusting ring 34 and the internal filter 32 are then slid into the casing 4. The crossover member 6 is then threadedly connected to the casing 4. The crossover member 6 abuts the internal filter 32 so as to press the internal filter 32, the adjusting ring 34, the sleeve 28 and the seal housing 26 against the shoulder 18. Movement of the sleeve 28 relative to the casing 4 is thereby prevented.

The operation of the bypass valve will now be described with reference to a drill string incorporating an MWD tool, the bypass valve, a single trip milling/whipstock assembly and a hydraulic anchor packer.

FIGS. 1 and 2 show the bypass valve in one of two open configurations in which the piston holes 56 are aligned with the vent chamber ports 40. In either of the two open configurations, wellbore fluid is able to flow from the piston bore 58 to the wellbore annulus, or vice versa. The bypass valve is arranged in a first open configuration (as shown in FIG. 1) when the guide pin 42 is located at positions A within the guide slot 52. In this first open configuration, the piston holes 56 are directly aligned with the vent chamber ports 40. The bypass valve is arranged in a second open configuration when the guide pin 42 is located at positions B within the guide slot 52. In this second open configuration, the piston holes 56 are partially aligned with the vent ports 40. A restricted path between the wellbore annulus and piston bore 58 is thereby defined. The positions of the piston holes 56 corresponding to the guide pin positions A and B are shown in FIG. 2.

The bypass valve is run into a wellbore arranged in the first open configuration. In so doing, wellbore fluid enters the drill string through the vent holes 20. Debris, such as drill cuttings, is prevented from entering the drill string by means of the filter discs 22. The filter discs 22 comprise a plurality of holes small enough to prevent the passage therethrough of any debris likely to hinder the operation of the bypass valve or any other part of the drill string. The flow of wellbore fluid into the bypass valve equalises the very high hydrostatic pressures exerted on the outer surface of the drill string.

The wellbore fluid held within the drill string is circulated down the drill string bore at a predetermined flow rate. The flow rate is sufficient for the operation of the MWD tool, but not high enough to generate the dynamic pressure required to activate the bypass valve. Consequently, wellbore fluid is pumped from the surface, through the MWD tool, into the wellbore annulus via the vent holes 20, and up the wellbore annulus to the surface. The hydraulic anchor packer is not thereby exposed to the required setting pressure differential.

The risk of premature activation of the bypass valve is reduced by the internal filter 32. The internal filter 32 reduces the likelihood of debris accumulating on the piston 30 and blocking the piston bore 58. Debris accumulation can readily occur resulting in an increase in the force exerted on the bypass valve piston at any given flow rate. If the debris accumulation on the piston is severe, then the piston can move unexpectedly. Although the internal filter 32 reduces the risk of this occurring, it is possible for very fine debris to still accumulate on the piston 30. If sufficient debris accumulates, then piston 30 may be unexpectedly moved towards a closed position in which the piston 30 prevents the flow of wellbore fluid through the vent holes 20. The piston 30 may also move in this manner if the piston spring 64 fails.

Movement of the piston 30 relative to the sleeve 28 is restricted by the location of the guide pin 42 within the guide slot 52. If the piston 30 unexpectedly moves towards a closed position, then the guide pin 42 moves from a position A within the guide slot 52 to a position B. In so doing, the piston 30 rotates within the sleeve 28 and moves axially to a part closed position in which the piston holes 56 are not directly aligned with the vent chamber ports 40, but are partly in fluid communication with the vent chamber ports 40 by means of the recess 47. Axial movement of the piston 30 is assisted by a venting of wellbore fluid from the spring chamber 62 via the piston spring chamber ports 68. The movement of the piston 30 into the part closed position generates a pressure rise of approximately 300–600 psi which may be measured at the surface. The pressure rise is sufficient to provide a clear indication at the surface that the bypass valve has moved into a part closed configuration, but not sufficient to generate the pressure differential of 1500–3000 psi required to set the hydraulic anchor packer.

If a pressure rise of approximately 300–600 psi is measured at the surface, then it is likely that the bypass valve has moved into a part closed configuration due to debris accumulation on the piston 30 or failure of the piston spring 64. Appropriate remedial action may be undertaken. Such action may involve reducing the flow rate of wellbore fluid down the drill string bore. Provided the piston spring 64 has not failed, the piston spring 64 will then push the piston 30 back to an open position. In so doing, the guide pin 42 moves from a position B to a new position A within the guide slot 52.

Once the required position and orientation of the whipstock has been obtained, the hydraulic anchor packer is set by moving the bypass valve into one of two closed configurations. In either of the closed configurations, the piston holes 56 are located uphole of the seals 77 so as to prevent the flow of wellbore fluid between the piston bore 58 and the wellbore annulus. The bypass valve is closed by cycling the piston 30 so that the guide pin 42 locates in positions C or D within the guide slot 52 (see FIG. 1). The two closed positions of the piston holes 56 corresponding to the guide pin positions C and D are shown in FIG. 2.

The aforementioned piston cycling is achieved by stopping the flow of wellbore fluid down the drill string bore to ensure that the guide pin 42 locates at a position A within the guide slot 52 by the action of the spring. The flow rate is then increased to move the piston 30 axially and thereby move the guide pin 42 to a position B. The process is repeated as necessary until the guide pin 42 locates in position B' within the guide slot 52. Stopping the fluid flow then moves the guide pin 42 to position C within the guide slot 52 under the action of the spring 64. In this first closed position, the piston 30 sealingly closes the vent chamber ports 40. The required setting pressure differential is then generated at the anchor packer. The movement of the piston 30 into a closed position produces a large pressure rise at the surface which may serve as an indication that the anchor packer has been set. This may be confirmed by attempting to move the drill string within the wellbore.

With the anchor packer set, the milling tool may be disconnected from the associated whipstock and operated by restarting the flow of fluid down the string. In so doing, the guide pin 42 moves to a position D within the guide slot 52 and the piston 30 moves to a second closed position. Since the bypass valve remains closed, the fluid flow required to drive the milling tool may be readily achieved. With the guide slot 52 of the present embodiment, once milling has begun, the fluid flow down the string may be stopped and restarted (i.e. milling may be stopped) on one occasion before a subsequent restarting of fluid flow locates the bypass valve in an open configuration.

The present invention is not limited to the specific embodiments described above. Alternative arrangements and materials will be apparent to a reader skilled in the art. For example, the internal filter 32 could be replaced, or added to, by inserting a three to four foot long standard drill pipe filter into a housing attached to the bypass valve assembly. The long length of the tubular filter pipe allows debris to collect without a significant pressure rise. Furthermore, the guide slot may be altered so that the piston must pass through an alternative number of part closed positions before moving to a fully closed position and/or an alternative number of fully closed positions before arranging the bypass valve in an open configuration. In a yet further alternative embodiment, the guide slot is such that the piston holes 56 directly (rather than partially) align with the vent ports 40 when the bypass valve is arranged in the second open configuration. An unrestricted (rather than restricted) path between the wellbore annulus and the piston bore 58 is thus defined. Accordingly, the bypass valve is provided with first and second open configurations in which said valve may be regarded as being fully open.

What is claimed is:

1. A bypass valve for selectively isolating the interior of a downhole assembly from the exterior thereof, the bypass valve comprising: a body incorporating a wall provided with at least one opening extending therethrough; a piston slidably mounted in the body and having a longitudinal bore extending therethrough, the piston being movable between a first position relative to the body, in which the bore of the piston is substantially isolated from the exterior of the body, and a second position relative to the body, in which a passage is provided from the bore of the piston to the exterior of the body via said at least one opening; and constraining means for controlling movement of the piston in response to fluid pressure applied to the piston, said constraining means comprising a guide pin and a guide slot for receiving the guide pin; the guide slot being arranged so as to prevent movement of the piston both from the first position to the second position and from the second position to the first position, and the guide slot is further arranged so as to permit said movement after a predetermined number of applications of a given minimum fluid pressure force to the piston.

2. A bypass valve as claimed in claim 1, wherein the piston has a third position relative to the body in which a restricted passage is provided from the bore of the piston to the exterior of the body via said at least one opening.

3. A bypass valve as claimed in claim 2, wherein movement of the piston to the third position is only permitted by the arrangement of the guide slot.

4. A bypass valve as claimed in claim 4, wherein the piston is biased to the first position by means of a spring.

5. A bypass valve as claimed in claim 1, wherein the piston incorporates a wall provided with at least one opening extending therethrough so that, in the first position, the openings of the piston and body are not in register with one another, and in the second position, the openings of the piston and the body are in register with one another.

6. A bypass valve as claimed in claim 1, wherein the guide slot is provided about the outer peripheral surface of the piston and extends in a direction having one component parallel to the direction of axial movement of the piston.

7. A bypass valve as claimed in claim 1, wherein the guide pin is fixedly located relative to the body and the guide slot is provided in the exterior surface of the piston.

8. A bypass valve as claimed in claim 1, wherein the arrangement of the guide slot is such that, upon application and release of said minimum fluid pressure force to the piston, the guide pin locates in a position within the guide slot different to that in which the guide pin was located prior to said application of fluid pressure.

9. A bypass valve as claimed in claim 1, wherein connecting means are provided for connecting a nozzle to the piston.

10. A bypass valve as claimed in claim 1, wherein a filter is provided adjacent the or each opening of the body.

11. A bypass valve as claimed in claim 1, wherein a filter is provided for filtering a fluid flowing into the bore of the piston.

* * * * *